US006242407B1

(12) United States Patent
Bertacchi et al.

(10) Patent No.: US 6,242,407 B1
(45) Date of Patent: Jun. 5, 2001

(54) LAUNDRY BLEACHING COMPOSITIONS

(75) Inventors: Gabriella Bertacchi, Genoa; Valerio Del Duca, Massalubrense; Carlo Ricci; Roberto Scaramella, both of Rome, all of (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/308,570

(22) PCT Filed: Nov. 20, 1997

(86) PCT No.: PCT/US97/21805

§ 371 Date: May 21, 1999

§ 102(e) Date: May 21, 1999

(87) PCT Pub. No.: WO98/22560

PCT Pub. Date: May 28, 1998

(30) Foreign Application Priority Data

Nov. 22, 1996 (EP) ..... 96870148

(51) Int. Cl.[7] ..... C11D 7/18

(52) U.S. Cl. ..... 510/372; 510/367; 510/375; 510/376; 252/186.1; 252/186.21; 252/186.42

(58) Field of Search ..... 510/321, 392, 510/320, 376, 367, 475, 530, 220, 276, 369, 370, 372, 375; 8/137; 252/186.39, 186.38, 186.43, 186.1, 186.21, 186.42

(56) References Cited

U.S. PATENT DOCUMENTS 5,622,646 * 4/1997 Scialla et al. ..... 252/186.33
5,686,014 * 11/1997 Baillely et al. ..... 252/186.33
5,814,304 * 9/1998 Wong et al. ..... 424/53
5,929,012 * 7/1999 Del Duca et al. ..... 510/303
6,010,993 * 1/2000 Romano et al. ..... 510/309

FOREIGN PATENT DOCUMENTS

672748 * 9/1995 (EP) .
844302 * 5/1998 (EP) .
WO9626999 * 9/1996 (WO) .
WO 97/02331 1/1997 (WO) ..... C09K/15/08

OTHER PUBLICATIONS

International Cosmetic Dictionary, Seventh Edition, 1995, CTFA, Inc., Washington, DC, 1995.*

Hawley's Condensed Chemical Dictionary, Twelth Edition, Richard Lewis, Van Nostrand Reinhold Company, NY, 1995.*

* cited by examiner

*Primary Examiner*—Yogendra Gupta
*Assistant Examiner*—Gregory Webb
(74) *Attorney, Agent, or Firm*—Richard S. Echler, Sr.; Kim William Zerby

(57) ABSTRACT

The present invention relates to a liquid composition suitable for bleaching fabrics comprising a peroxygen bleach, from 0.001% to 10% by weight of the total composition of propyl gallate, and from 0.001% to 10% by weight of an antioxidant. These compositions are suitable for bleaching soiled fabrics, and especially pretreating fabrics while being safe to the fabrics and colors.

17 Claims, No Drawings

LAUNDRY BLEACHING COMPOSITIONS

TECHNICAL FIELD

The present invention relates to the bleaching of soiled fabrics and to compositions suitable to be used as laundry detergent, preferably as laundry pretreater.

BACKGROUND

Peroxygen bleach-containing compositions have been extensively described in laundry applications as laundry detergents, laundry additives or even laundry pretreaters.

Indeed, it is known to use such peroxygen bleach-containing compositions in laundry treatment applications to boost the removal of encrustated stains/soils which are otherwise particularly difficult to remove, such as grease, coffee, tea, grass, mud/clay-containing soils and the like. However, we have found that a drawback associated with such peroxygen bleach-containing compositions is that the compositions may damage fabrics resulting in tensile strength loss and/or color damage, especially when used in a pretreatment application, i.e., when applied directly (neat) onto the fabrics, and left to act onto the fabrics for prolonged periods of time before washing the fabrics.

It is thus an object of the present invention to provide improved fabric safety and/or color safety to fabrics upon bleaching, especially in pretreatment applications where the compositions are left neat into contact with the fabrics for prolonged periods of time before washing.

Indeed, when bleaching fabrics with a composition comprising a peroxygen bleach like hydrogen peroxide, it has been found that the presence of metal ions such as copper and/or iron and/or manganese and/or chromium on the surface of the fabrics and/or the exposure to UV radiation from sunlight of the fabrics after having been contacted with the peroxygen bleach-containing composition, produces fabric damage resulting in loss of tensile strength of the fabric fibres and/or in color damage of the fabrics. Indeed, it is speculated that the presence of metal ions such as copper and/or iron and/or manganese and/or chromium on the surface of the fabrics, especially on cellulosic fibres, and/or the exposure of the fabrics to UV radiation from sunlight catalyse the radical decomposition of peroxygen bleaches like hydrogen peroxide. Thus, it is believed that a radical reaction occurs on the surface of the fabrics with generation of free radicals, which results in tensile strength loss. Furthermore, it is speculated that this generation of free radicals may further provide an aggressive decomposition of certain dyes present in the fabrics resulting thereby in chemical damage of dye molecules which is visible as discoloration and/or hue change. Dyes commonly present in colored fabrics include metal containing dyes like copper-formazan dyes or metal-azo dyes.

It has now been found that improved fabric safety and/or color safety can be achieved by formulating a liquid bleaching composition comprising a peroxygen bleach, propyl gallate and an antioxidant. More particularly, it has been found that the use, in a peroxygen bleach-containing composition for bleaching fabric, of an antioxidant together with propyl gallate, considerably reduces the color damage and/or fabric damage on a fabric bleached with such a composition, especially in a pretreatment application.

An advantage of the present invention is that excellent laundry performance on a broad range of stains and soils such as bleachable stains and/or greasy stains is also provided.

Another advantage of the present invention is that the compositions according to the present invention provide excellent performance when used in any laundry applications, for instance when used as a laundry detergent or a laundry additive, and especially when used as a laundry pretreater, or even in other applications like in hard surface cleaning applications.

Yet another advantage is that the compositions herein are physically and chemically stable upon prolonged periods of storage.

EP-B-209 228 discloses compositions comprising a peroxide source like hydrogen peroxide, metal chelating agents such as amino polyphosphonate chelants and free radical scavengers at a level of from 0.005% to 0.04% by weight of the total composition. No propyl gallate is disclosed.

European patent application number 95870082.5 discloses a peroxygen bleach-containing composition comprising two types of radical scavengers and optionally a chelating agent. No antioxidants are disclosed.

European patent application number 95870079.1 discloses a peroxygen bleach-containing compositions comprising a polyamine, and optionally a chelating agent and a radical scavenger. No antioxidants are disclosed.

In none of these patent applications it is mentioned nor suggested that the use of an antioxidant together with propyl gallate, in a peroxygen bleach-containing composition, reduce the loss of tensile strength in fabrics and/or color damage of said fabrics, when said fabrics are bleached with said composition.

SUMMARY OF THE INVENTION

The present invention encompasses a liquid composition suitable for bleaching fabrics comprising a peroxygen bleach, from 0.001% to 10% by weight of the total composition of propyl gallate, and from 0.001 % to 10% by weight of an antioxidant. In a preferred embodiment the composition further comprises a chelating agent.

The present invention further encompasses processes of bleaching fabrics, starting from a liquid composition as defined herein. The processes include the steps of contacting said fabrics with the liquid bleaching composition neat or diluted, and subsequently rinsing said fabrics. In the preferred embodiment, when the fabrics are "pretreated", the composition is applied neat on the fabrics, and the fabrics are subsequently washed in a normal wash cycle.

DETAILED DESCRIPTION OF THE INVENTION

The present invention encompasses a liquid composition comprising a peroxygen bleach, from 0.001% to 10% by weight of a propyl gallate and from 0.001% to 10% by weight of an antioxidant.

As an essential element the compositions according to the present invention comprise a peroxygen bleach or a mixture thereof. Indeed, the presence of peroxygen bleach provides excellent bleaching and cleaning benefits. Suitable peroxygen bleaches to be used herein are hydrogen peroxide, water soluble sources thereof, or mixtures thereof. As used herein a hydrogen peroxide source refers to any compound which produces perhydroxyl ions when said compound is in contact with water.

Suitable water-soluble sources of hydrogen peroxide for use herein include percarbonates, persilicates, persulphates such as monopersulfate, perborates, peroxyacids such as diperoxydodecandioic acid (DPDA), magnesium perphtalic acid, perlauric acid, perbenzoic and alkylperbenzoic acids, hydroperoxides, aliphatic and aromatic diacyl peroxides, and mixtures thereof. Preferred peroxygen bleaches herein are hydrogen peroxide, hydroperoxide and/or diacyl peroxide. Hydrogen peroxide is the most preferred peroxygen bleach herein.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide. Such hydroperoxides have the advantage to be particularly safe to fabrics and color while delivering excellent bleaching performance.

Suitable aliphatic diacyl peroxides for use herein are dilauroyl peroxide, didecanoyl peroxide, dimyristoyl peroxide, or mixtures thereof. Suitable aromatic diacyl peroxide for use herein is for example benzoyl peroxide. Such diacyl peroxides have the advantage to be particularly safe to fabrics and color while delivering excellent bleaching performance.

Typically, the compositions herein comprise from 0.1% to 20% by weight of the total composition of said peroxygen bleach or mixtures thereof, preferably from 1% to 15% and most preferably from 2% to 10%.

As a second essential element the compositions according to the present invention comprise propyl gallate. Typically, the compositions herein comprise from 0.001% to 10% by weight of the total composition of propyl gallate, preferably from 0.002% to 5%, more preferably from 0.005% to 2%, and most preferably from 0.05% to 1%.

N-propyl-gallate may be commercially available from Nipa Laboratories under the trade name Nipanox S1®.

As a third essential element the compositions according to the present invention comprise an antioxidant or mixtures thereof. Typically, the compositions herein comprise from 0.001% to 10% by weight of the total composition of an antioxidant or mixtures thereof, preferably from 0.002% to 5%, more preferably from 0.005% to 2%, and most preferably from 0.01% to 1%.

By "antioxidant" it is meant herein any compound able to regenerate the oxidized propyl gallate into its non-oxidized form.

Suitable antioxidants to be used herein include organic acids like citric acid, ascorbic acid, tartaric acid, adipic acid and sorbic acid, or amines like lecithin, or aminoacids like glutamine, methionine and cysteine, or esters like ascorbil palmitate, ascorbil stearate and triethylcitrate, or mixtures thereof.

Preferred antioxidants for use herein are citric acid, ascorbic acid, ascorbil palmitate, lecithin or mixtures thereof and more preferred is citric acid.

The present invention is based on the finding that, fabric damage resulting in tensile strength loss is reduced, when a liquid composition comprising a peroxygen bleach, propyl gallate and an antioxidant, is used to bleach a soiled fabric, as compared to the use of the same composition but without any antioxidant.

In other words the use, in a peroxygen bleach-containing composition, of a propyl gallate and an antioxidant, allows to considerably reduce the tensile strength loss caused by the presence of copper and/or iron and/or manganese and/or chromium on the fabric surface and/or by the exposure to UV radiation from sunlight of the fabric after having been bleached with said composition, especially in a pretreatment application where the composition is left onto the fabric to be pretreated upon a prolonged period of time before washing said fabric, e.g. about 24 hours, and/or where the fabric is contaminated by high levels of copper and/or iron and/or manganese and/or chromium, e.g. about 50 ppm of copper per gram of fabric, and/or where the fabric is left under sunlight exposure for prolonged periods of time, e.g. about 12 hours.

The tensile strength loss of a fabric may be measured by employing the Tensile Strength method. This method consists in measuring the tensile strength of a given fabric by stretching said fabric until it breakes. The force, expressed in Kg, necessary to break the fabric is the "Ultimate Tensile Stress" and may be measured with a Stress-Strain INSTRON® Machine available from INSTRON. The loss of tensile strength is the difference between the tensile strength of a fabric taken as a reference, i.e. a fabric which has not been bleached, and the tensile strength of the same fabric after having been bleached. A tensile strength loss of zero means that no fabric damage is observed.

The present invention is further based on the finding that, the color damage of some kinds of dyes present on colored fabrics, as bleach sensitive dyes or metallized dyes, i.e., the color change and/or decoloration, observed when bleaching such soiled colored fabrics with a peroxygen bleach-containing composition comprising propyl gallate and an antioxidant, is reduced, as compared to the color change and/or decoloration observed when using the same composition but without any antioxidant. This color change and/or decoloration reduction is observed especially -in a pretreatment application where the composition is left onto the soiled colored fabrics upon prolonged periods of time before washing the fabrics, e.g. about 24 hours. In other words, the use of propyl gallate together with an antioxidant, in a peroxygen bleach-containing composition, for bleaching fabrics, allows to prevent the decomposition (oxidation) of dyes generally present on the surface of colored fabrics such as bleach sensitive dyes and/or metallized dyes including copper-formazan dyes and/or metal-azo dyes.

The color damage of a colored fabric may be evaluated by visual grading and/or by an instrumental method with the HunterLab Tristimulus MINISCAN® by comparing side by side colored fabrics bleached according to the present invention and colored fabrics bleached with a reference composition being for example free of any antioxidant.

Also fabric tensile strength loss reduction and/or color damage reduction are obtained according to the present invention, without compromising on the bleaching performance nor on the stain removal performance.

It is speculated that the presence of metal ions or UV radiations from sunlight catalyse the radical decomposition of a peroxygen bleach like for instance hydrogen peroxide. Thus, a radical decomposition occurs with generation of free radicals. Such free radical reactions are self-propagating and become a chain reaction until a termination product is formed, thus inactivating the peroxygen bleach. Also once formed the free radicals are free to interact with fabrics thereby reducing the tensile strength of the fabrics, and/or are free to combine with dyes present on the fabrics resulting thereby in color damage. It is speculated that the antioxidant and propyl gallate act together to reduce the tensile strength loss and/or color damage of the fabric. Indeed, it is believed that propyl gallate reduces the chain mechanism of the free radical formation by reacting with the free radicals formed, and thus inactivates them, while being itself oxidized. It is further speculated that the antioxidant contributes to regenerate the oxidized propyl gallate into propyl gallate, thus making it more available to inactivate the free radicals formed.

Also an advantage of the compositions of the present invention is that they are physically and chemically stable upon prolonged periods of storage. More particularly, propyl gallate and the antioxidant, in the compositions according to the present invention, contribute to the excellent chemical stability of said compositions upon prolonged storage periods. Indeed a secondary benefit of the antioxidants used in the compositions herein is that they absorb oxygen present in the bleaching environment and thus reduce the oxidation decomposition of the oxidable ingredients present in the bleaching compositions, namely the peroxygen bleaches, perfumes, dyes and the like.

Chemical stability of the compositions herein may be evaluated by measuring the concentration of available oxygen (often abbreviated to AvO2) at given storage time after having manufactured the compositions. The concentration of available oxygen can be measured by chemical titration methods known in the art, such as the iodometric method, thiosulphatimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

By "physically stable" it is meant herein that no phase separation occurs in the compositions for a period of 14 days at 50° C.

The compositions of the present invention may comprise a chelating agent as a highly preferred optional ingredient. Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

A chelating agent is desired herein as it further contributes to the benefit of the bleaching compositions of the present invention, i.e. to reduce tensile strength loss of fabrics and/or color damage, especially in a laundry pretreatment application. Indeed, the chelating agents inactivate the metal ions present on the surface of the fabrics and/or in the bleaching compositions (neat or diluted) that otherwise would contribute to the radical decomposition of the peroxygen bleach.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST)®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexaacetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Another chelating agent for use herein is of the formula:

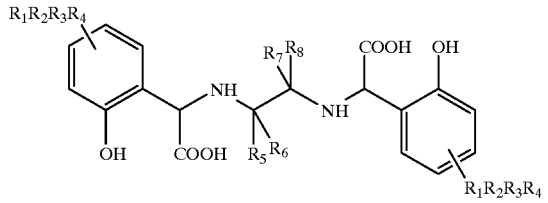

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R' is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention comprise up to 5% by weight of the total composition of a chelating agent, or mixtures thereof, preferably from 0.01% to 1.5% by weight and more preferably from 0.01% to 0.5%.

The compositions according to the present invention are liquid compositions as opposed to a solid or a gas. As used herein "liquid" includes "pasty" compositions. The liquid compositions of the present invention preferably have a viscosity of from 5 cps to 10 000 cps at 50 rpm shear rate and 20° C.

Preferably the liquid compositions herein are aqueous. Said aqueous compositions have a pH as is of from 1 to 11, preferably from 2 to 6, more preferably from 2 to 5.5. The pH of the compositions can be adjusted by using organic or inorganic acids, or alkalinising agents.

The compositions of the present invention may further comprise any surfactant known to those skilled in the art including nonionic, anionic, cationic, zwitterionic and/or amphoteric surfactants.

Accordingly, the compositions of the present invention further comprise a nonionic surfactant, or mixtures thereof. Typically, the compositions according to the present invention may comprise from 0.01% to 50% by weight of the total composition of a nonionic surfactant, or mixtures thereof, preferably from 0.1% to 35% and more preferably from 0.5% to 30%.

Suitable nonionic surfactants to be used herein are fatty alcohol ethoxylates and/or propoxylates which are commercially available with a variety of fatty alcohol chain lengths and a variety of ethoxylation degrees. Indeed, the HLB values of such alkoxylated nonionic surfactants depend essentially on the chain length of the fatty alcohol, the nature of the alkoxylation and the degree of alkoxylation. Surfactant catalogues are available which list a number of surfactants, including nonionics, together with their respective HLB values.

Suitable chemical processes for preparing the nonionic surfactants for use herein include condensation of corresponding alcohols with alkylene oxide, in the desired proportions. Such processes are well known to the man skilled in the art and have been extensively described in the art.

Particularly suitable for use herein as nonionic surfactants are hydrophobic nonionic surfactants having an HLB (hydrophilic-lipophilic balance) below 16, preferably below 15, more preferably below 12, and most preferably below 10. Those hydrophobic nonionic surfactants have been found to provide good grease cutting properties.

Preferred hydrophobic nonionic surfactants to be used in the compositions according to the present invention are surfactants having an HLB below 16 and being according to the formula $RO—(C_2H_4O)_n n(C_3H_6O)_m H$, wherein R is a $C_6$ to $C_{22}$ alkyl chain or a $C_6$ to $C_{28}$ alkyl benzene chain, and wherein n+m is from 0 to 20 and n is from 0 to 15 and m is from 0 to 20, preferably n+m is from 1 to 15 and, n and m are from 0.5 to 15, more preferably n+m is from 1 to 10 and, n and m are from 0 to 10. The preferred R chains for use herein are the $C_8$ to $C_{22}$ alkyl chains. Accordingly suitable hydrophobic nonionic surfactants for use herein are Dobanol$^R$ 91-2.5 (HLB=8.1; R is a mixture of C9 and $C_{11}$ alkyl chains, n is 2.5 and m is 0), or Lutensol$^R$ TO3 (HLB=8; R is a $C_{13}$ alkyl chains, n is 3 and m is 0), or Lutensol$^R$ AO3 (HLB=8; R is a mixture of $C_{13}$ and $C_{15}$ alkyl chains, n is 3 and m is 0), or Tergitol$^R$ 25L3 (HLB=7.7; R is in the range of $C_{12}$ to $C_{15}$ alkyl chain length, n is 3 and m is 0), or Dobanol $^R$ 23-3 (HLB=8.1; R is a mixture of $C_{12}$ and $C_{13}$ alkyl chains, n is 3 and m is 0), or Dobanol$^R$ 23-2 (HLB=6.2; R is a mixture of $C_{12}$ and $C_{13}$ alkyl chains, n is 2 and m is 0), or Dobanol$^R$ 45-7 (HLB=11.6; R is a mixture of $C_{14}$ and $C_{15}$ alkyl chains, n is 7 and m is 0) Dobanol$^R$ 23-6.5 (HLB=11.9; R is a mixture of $C_{12}$ and $C_{13}$ alkyl chains, n is 6.5 and m is 0), or Dobanol$^R$ 25-7 (HLB=12; R is a mixture of $C_{12}$ and $C_{15}$ alkyl chains, n is 7 and m is 0), or Dobanol$^R$ 91-5 (HLB=11.6; R is a mixture of $C_9$ and $C_{11}$ alkyl chains, n is 5 and m is 0), or Dobanol$^R$ 91-6 (HLB=12.5; R is a mixture of $C_9$ and $C_{11}$ alkyl chains, n is 6 and m is 0), or Dobanol$^R$ 91-8 (HLB=13.7; R is a mixture of $C_9$ and $C_{11}$ alkyl chains, n is 8 and m is 0), Dobanol $^R$ 91-10 (HLB=14.2; R is a mixture of $C_9$ to $C_{11}$ alkyl chains, n is 10 and m is 0), or mixtures thereof. Preferred herein are Dobanol$^R$ 91-2.5 , or Lutensol$^R$ TO3, or Lutensol$^R$ AO3, or Tergitol$^R$ 25L3, or Dobanol$^R$ 23-3, or Dobanol$^R$ 23-2, or mixtures thereof. These Dobanol$^R$ surfactants are commercially available from SHELL. These Lutensol$^R$ surfactants are commercially available from BASF and these Tergitol$^R$ surfactants are commercially available from UNION CARBIDE.

Preferred herein the compositions according to the present invention further comprise an anionic surfactant, or mixtures thereof. Said anionic surfactants which are hydrophilic compounds act together with the hydrophobic surfactants such as to counterbalance the negative effect of hydrophobic surfactants. Said anionic surfactants act as wetting agent, i.e. in laundry application they wet the stains on the fabrics, especially on hydrophilic fabrics, and thus help the peroxygen bleach, typically hydrogen peroxide, to perform its bleaching action thereby contributing to improved laundry performance on bleachable stains. Furthermore, the anionic surfactants herein allow to obtain clear compositions even when said compositions comprise hydrophobic ingredients such as hydrophobic surfactants. Typically, the compositions according to the present invention may comprise from 0.1% to 20% by weight of the total composition of said anionic surfactant, or mixtures thereof, preferably from 0.2% to 15% and more preferably from 0.5% to 13%.

Particularly suitable for use herein are sulfonate and sulfate surfactants. The like anionic surfactants are well-known in the art and have found wide application in commercial detergents. These anionic surfactants include the C8–C22 alkyl benzene sulfonates (LAS), the C8–C22 alkyl sulfates (AS), unsaturated sulfates such as oleyl sulfate, the C10–C18 alkyl alkoxy sulfates (AES) and the C10–C18 alkyl alkoxy carboxylates. The neutralising cation for the anionic synthetic sulfonates and/or sulfates is represented by conventional cations which are widely used in detergent technology such as sodium, potassium or alkanolammonium. Preferred herein are the alkyl sulphate, especially coconut alkyl sulphate having from 6 to 18 carbon atoms in the alkyl chain, preferably from 8 to 15, or mixtures thereof.

The compositions according to the present invention may further comprise a foam suppressor such as 2-alkyl alkanol, or mixtures thereof, as a highly preferred optional ingredient. Particularly suitable to be used in the present invention are the 2-alkyl alkanols having an alkyl chain comprising from 6 to 16 carbon atoms, preferably from 8 to 12 and a terminal hydroxy group, said alkyl chain being substituted in the a position by an alkyl chain comprising from 1 to 10 carbon atoms, preferably from 2 to 8 and more preferably 3 to 6. Such suitable compounds are commercially available, for instance, in the Isofol® series such as Isofol® 12 (2-butyl octanol) or Isofol® 16 (2-hexyl decanol). Typically, the compositions herein may comprise from 0.05% to 2% by weight of the total composition of a 2-alkyl alkanol, or mixtures thereof, preferably from 0.1% to 1.5% and most preferably from 0.1% to 0.8%.

The compositions herein may further comprise a variety of other optional ingredients such as builders, stabilisers, bleach activators, soil suspenders, soil suspending polyamine polymers, polymeric soil release agents, radical scavengers, catalysts, dye transfer agents, solvents, brighteners, perfumes, and dyes.

In the present invention, the liquid bleaching composition of the present invention needs to be contacted with the fabrics to be bleached. This can be done either in a so-called "pretreatment mode", where the liquid composition is applied neat onto said fabrics before the fabrics are rinsed, or washed then rinsed, or in a "soaking mode" where the liquid composition is first diluted in an aqueous bath and the fabrics are immersed and soaked in the bath, before they are rinsed, or in a "through the wash mode", where the liquid composition is added on top of a wash liquor formed by dissolution or dispersion of a typical laundry detergent.

It is also essential in both cases, that the fabrics be rinsed after they have been contacted with said composition, before said composition has completely dried off.

Indeed, it has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation generates peroxy-radicals which may contribute to the degradation of cellulose. Thus, not leaving the liquid compositions, as described herein, to dry onto the fabric, in a process of pretreating soiled fabrics, contributes to the benefits according the present invention, i. e., to reduce the tensile strength loss and/or color damage when pretreating fabrics with liquid peroxygen bleach-containing compositions.

In the pretreatment mode, the process comprises the steps of applying said liquid composition in its neat form onto said fabrics, or at least soiled portions thereof, and subsequently rinsing, or washing then rinsing said fabrics. In this mode, the neat compositions can optionally be left to act onto said fabrics for a period of time ranging from 1 min. to 1 hour, before the fabrics are rinsed, or washed then rinsed, provided that the composition is not left to dry onto said fabrics. For particularly though stains, it may be appropriate to further rub or brush said fabrics by means of a sponge or a brush, or by rubbing two pieces of fabrics against each other.

In another mode, generally referred to as "soaking", the process comprises the steps of diluting said liquid composition in its neat form in an aqueous bath so as to form a diluted composition. The dilution level of the liquid composition in an aqueous bath is typically up to 1:85, preferably up to 1:50 and more preferably about 1:25 (composition:water). The fabrics are then contacted with the aqueous bath comprising the liquid composition, and the fabrics are finally rinsed, or washed then rinsed. Preferably in that embodiment, the fabrics are immersed in the aqueous bath comprising the liquid composition, and also preferably, the fabrics are left to soak therein for a period of time ranging from 1 minute to 48 hours, preferably from 1 hour to 24 hours.

In yet another mode which can be considered as a sub-embodiment of "soaking", generally referred to as "bleaching through the wash", the liquid composition is used as a so-called laundry additive. And in that embodiment the aqueous bath is formed by dissolving or dispersing a conventional laundry detergent in water. The liquid composition in its neat form is contacted with the aqueous bath, and the fabrics are then contacted with the aqueous bath containing the liquid composition. Finally, the fabrics are rinsed.

Depending on the end-use envisioned, the compositions herein can be packaged in a variety of containers including conventional bottles, bottles equipped with roll-on, sponge, brusher or sprayers, or sprayers.

Although preferred application of the compositions described herein is laundry application and especially laundry pretreatment, the compositions according to the present invention may also be used as a household cleaner in the cleaning of bathroom surfaces or kitchen surfaces.

The invention is further illustrated by the following examples.

EXAMPLES

Following compositions were made by mixing the listed ingredients in the listed proportions (weight % unless otherwise specified).

| Compositions | I | II | III | IV | V | VI | VII | VIII |
|---|---|---|---|---|---|---|---|---|
| C12 Alkylsulphate | 1.7 | 1.7 | 1.7 | 1.2 | 1.7 | 1.2 | 1.7 | 1.7 |
| Dobanol ® 91-10 | 1.6 | 1.6 | 1.6 | 1.6 | 1.6 | 1.6 | 1.6 | 1.6 |
| Dobanol ® 23-3 | 1.5 | 1.1 | 1.1 | 1.1 | 1.1 | 1.1 | 1.5 | 1.5 |
| $H_2O_2$ | 7.0 | 7.0 | 7.0 | 7.0 | 7.0 | 7.0 | 7.0 | 7.0 |
| Isofol ® 12 | 0.5 | 0.5 | 0.5 | 0.5 | 0.5 | 0.5 | 0.5 | 0.5 |
| DTPA | 0.1 | — | — | — | 0.1 | — | — | — |
| HEDP | — | 0.16 | — | 0.16 | — | — | 0.16 | 0.16 |
| DTPMP | — | — | 0.18 | — | — | 0.18 | — | — |
| Propyl gallate | 0.1 | 0.1 | 0.3 | 0.3 | 0.1 | 0.1 | 0.1 | 0.1 |
| Citric acid | 0.05 | 0.05 | 0.05 | — | — | — | 0.05 | 0.05 |
| Ascorbic acid | — | — | — | 0.05 | — | — | 0.05 | — |
| Ascorbil Palmitate | — | — | — | — | 0.05 | — | — | 0.05 |
| Lecithine | — | — | — | — | — | 0.05 | — | — |
| Water and minors | | | | up to 100% | | | | |
| H2SO4 up to pH 4 | | | | | | | | |

DTPA is diethylene triamine penta acetic acid.
HEDP is 1-hydroxy-ethane diphosphonate.
DTPMP is diethylene triamine penta methylene phosphonate.

| Compositions | IX | X | XI | XII | XIII |
|---|---|---|---|---|---|
| C 12 Alkylsulphate | 1.7 | 1.2 | 2 | 2 | 2 |
| Dobanol ® 45-7 | 1.6 | 1.6 | 6.4 | 6.4 | 6.4 |
| Dobanol ® 23-3 | 1.5 | 1.1 | 8.6 | 8.6 | 8.6 |
| $H_2O_2$ | 7.0 | 7.0 | 7.0 | 7.0 | 7.0 |
| Isofol ® 12 | 0.5 | 0.5 | — | — | — |
| DTPA | 0.1 | — | — | — | 0.1 |
| HEDP | — | — | 0.16 | — | — |
| DTPMP | — | 0.18 | — | 0.4 | — |
| Propyl gallate | 0.1 | 0.1 | 0.1 | 0.3 | 0.3 |
| Citric acid | 0.05 | — | 0.05 | 0.1 | — |
| Ascorbic acid | — | — | — | — | — |
| Ascorbil Palmitate | — | — | — | — | 0.05 |
| Lecithine | — | 0.05 | — | — | — |
| Water and minors | | | up to 100% | | |
| H2SO4 up to pH 4 | | | | | |

Compositions I to XIII when used to bleach soiled colored fabrics exhibit excellent fabric safety as well as good color safety to the fabrics bleached therewith.

For example in a pretreatment mode, compositions I to XIII are applied neat on the stained portion of a fabric and left to act thereon for 5 minutes. Then the fabric is washed with a conventional detergent and rinsed. Surprisingly, excellent fabric safety as well as good color safety is obtained with these compositions, this even when leaving these compositions to act onto the fabrics for prolonged time, e.g. 24 hours, before washing the fabrics, and even leaving the compositions to form a border between pretreated and not-pretreated areas of the fabrics. This border is usually the more damaged region of a metal polluted cotton fabric or of a colored item.

In a bleaching-through-the-wash mode, any of the compositions I to XIII is contacted with an aqueous bath formed by dissolution of a conventional detergent in water. Fabrics are then contacted with the aqueous bath comprising the liquid detergent, and the fabrics are rinsed. They can also be used in a soaking mode, where 100 ml of the liquid compositions are diluted in 10 liters of water. The fabrics are then contacted with this aqueous bath containing the composition, and left to soak therein for a period of time of 24 hours. The, fabrics are eventually rinsed.

What is claimed is:

1. A liquid bleaching composition comprising:

a) from 0.1% to 20% by weight, of a peroxygen bleach, said peroxygen bleach is selected from the group consisting of tert-butylhydroperoxide, cumyl hydroperoxide, 2,4,4-trimethylpentyl-2-hydroperoxide, di-isopropylbenzene monohydroperoxide, tert-amyl hydroperoxide, 2,5-dimethylhexane-2,5-dihydroperoxide, dilauroyl peroxide, didecanoyl peroxide, dimyristoyl peroxide, and mixtures thereof;

b) from 0.001% to 10% by weight, of propyl gallate;

c) from 0.001% to 10% by weight, of an anti-oxidant; and d) the balance carriers and adjunct ingredients.

2. A composition according to claim 1 comprising from 0.002% to 5% by weight, of propyl gallate.

3. A composition according to claim 2 comprising from 0.005% to 2% by weight, of propyl gallate.

4. A composition according to claim 3 comprising from 0.05% to 1% by weight, of propyl gallate.

5. A composition according to claim 1 comprising from 0.002% to 5% by weight, of an anti-oxidant.

6. A composition according to claim 5 comprising from 0.005% to 2% by weight, of an anti-oxidant.

7. A composition according to claim 6 comprising from 0.01% to 1% by weight, of an anti-oxidant.

8. A composition according to claim 1 comprising from 1% to 15% by weight, of a peroxygen bleach.

9. A composition according to claim 8 comprising from 2% to 10% by weight, of a peroxygen bleach.

10. A composition according to claim 1 wherein said peroxygen bleach is hydrogen peroxide.

11. A composition according to claim 1 wherein said anti-oxidant is selected from the group consisting of citric acid, ascorbic acid, tartaric acid, adipic acid, sorbic acid, lecithin, glutamine, methionine, cysteine, ascorbil palmitate, ascorbil stearate, triethylcitrate, and mixtures thereof.

12. A composition according to claim 11 wherein said anti-oxidant is citric acid.

13. A composition according to claim 1 further comprising from 0.01% to 5% by weight, of a chelant.

14. A composition according to claim 13 further comprising from 0.01% to 0.5% by weight, of a chelant.

15. A composition according to claim 13 wherein said chelant is selected from the group consisting of amino aminotri(methylene phosphonic acid), di-ethylenetriaminopentaacetic acid, diethylenetriamine pentamethylene phosphonate, 1-hydroxyethane diphosphonate, ethylenediamine-N,N'-disuccinic acid, and mixtures thereof.

16. A liquid bleaching composition comprising:

a) from 0.1% to 20% by weight, of a peroxygen bleach, said peroxygen bleach selected from the group consisting of tert-butylhydroperoxide, cumyl hydroperoxide, 2,4,4-trimethylpentyl-2-hydroperoxide, di-isopropylbenzene monohydroperoxide, tert-amyl hydroperoxide, 2,5-dimethylhexane-2,5-dihydroperoxide, dilauroyl peroxide, didecanoyl peroxide, dimyristoyl peroxide, benzoyl peroxide, and mixtures thereof;

b) from 0.001% to 10% by weight, of propyl gallate;

c) from 0.001% to 10% by weight, of an anti-oxidant, said anti-oxidant selected from the group consisting of citric acid, ascorbic acid, tartaric acid, adipic acid, sorbic acid, lecithin, glutamine, methionine, cysteine, ascorbil palmitate, ascorbil stearate, triethylcitrate, and mixtures thereof; and d) the balance carriers and adjunct ingredients.

17. A composition according to claim 16 further comprising from 0.1% to 20% by weight, of an anionic surfactant.

* * * * *